US006813800B2

(12) United States Patent
Liccardi

(10) Patent No.: US 6,813,800 B2
(45) Date of Patent: Nov. 9, 2004

(54) MOP HEAD AND METHOD OF USE

(75) Inventor: Pia C. Liccardi, Mountain Lakes, NJ (US)

(73) Assignee: Pia C. Licciardi, Mountain Lakes, NJ (US)

( * ) Notice: Subject to any disclaimer, the term of this patent is extended or adjusted under 35 U.S.C. 154(b) by 258 days.

(21) Appl. No.: 10/083,764

(22) Filed: Feb. 25, 2002

(65) Prior Publication Data

US 2003/0159714 A1 Aug. 28, 2003

(51) Int. Cl.[7] ..... A47L 13/20

(52) U.S. Cl. ..... 15/228; 15/210.1; 15/244.1; 134/6

(58) Field of Search ..... 15/228, 210.1, 15/244.1, 244.2, 244.4, 209.1, 244.3; 134/6

(56) References Cited

U.S. PATENT DOCUMENTS

| | | | | | |
|---|---|---|---|---|---|
| 2,304,127 | A | * | 12/1942 | Stetson | 15/231 |
| 2,413,872 | A | * | 1/1947 | Hoyer | 15/119.2 |
| 3,038,188 | A | * | 6/1962 | Rebernak | 15/119.2 |
| 3,214,779 | A | * | 11/1965 | Wheeler | 15/244.2 |
| 3,465,377 | A | * | 9/1969 | Thomas | 15/147.1 |
| 4,077,083 | A | | 3/1978 | Siemund et al. | |
| 4,114,224 | A | | 9/1978 | Disko | |
| 4,718,141 | A | | 1/1988 | Kuehnl | |
| 4,962,563 | A | | 10/1990 | Bachar | |
| 5,067,197 | A | * | 11/1991 | Cormier | 15/244.1 |
| 5,457,844 | A | | 10/1995 | Hanna et al. | |
| 5,512,121 | A | | 4/1996 | Brown, Jr. | |
| 5,533,226 | A | | 7/1996 | Brown, Jr. | |
| 5,735,620 | A | | 4/1998 | Ford | |
| 5,887,309 | A | | 3/1999 | Lin | |
| 5,922,140 | A | | 7/1999 | Wills | |
| 6,026,530 | A | | 2/2000 | Camp, Jr. | |
| 6,223,381 | B1 | | 5/2001 | Brown, Jr. | |

* cited by examiner

*Primary Examiner*—Terrence R. Till
*Assistant Examiner*—Shay Balsis
(74) *Attorney, Agent, or Firm*—Morgan & Finnegan, LLP; Mark J. Abate, Esq.

(57) ABSTRACT

A mop head having a sculpted cutout in at least one side surface that corresponds to the shape of floor molding to allow for cleaning of the floor molding and floor together.

8 Claims, 1 Drawing Sheet

MOP HEAD AND METHOD OF USE

FILED OF THE INVENTION

The present invention generally relates to a mop head and a method of using the mop head. Specifically described herein is a mop head that is suitable for cleaning molding.

BACKGROUND

Currently a variety types of mop heads are available for use in mopping floors. For example, cloth string mop heads have been widely used as well as sponge mop heads. These type of mops have proven to be very durable and useful for the cleaning of floors. In addition, various mechanisms have been used to squeeze water out of mop heads to allow rinsing of the mop head while cleaning a floor.

In many residential and commercial buildings, there are floor moldings (e.g. wooden strips) at the intersection of the floor and walls. Dust and dirt often builds up on these moldings. This dust and dirt has to be cleaned, for example, by use of a dust cloth or vacuum cleaner.

SUMMARY

The mop head described herein has a sculpted cutout or indentations in at least one side surface that corresponds to the shape of floor molding to allow for cleaning of the floor molding and the floor together. No previous tool has been used for cleaning both the floor and floor molding.

One problem with prior art mop heads was that they did not allow for cleaning of floor molding. Dust and dirt that built up on the floor molding either had to be separately cleaned with, for example, a dust cloth, or could end up falling off the molding onto the floor after the floor had been cleaned. Neither of those alternatives was desirable.

The mop head described herein allows for the cleaning of the floor and the molding together (e.g. at the same time). In addition, by allowing for the cleaning of dust and dirt off the floor moldings when the floor is being cleaned, the mop head increases the efficiency of the person cleaning.

DETAILED DESCRIPTION OF THE PREFERRED EMBODIMENT

Figure 1:
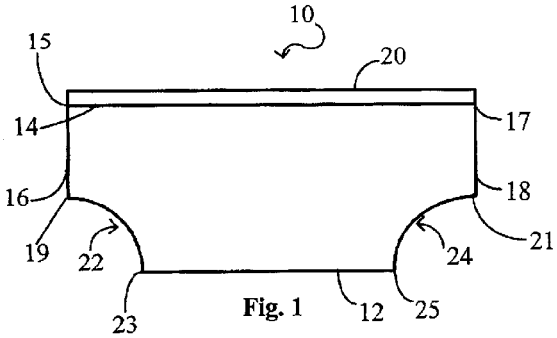
FIG. 1 is a front view of an embodiment of the mop head.

FIG. 1 shows a front view of an embodiment of the mop head. The mop head 10 has lower and upper surfaces 12 and 14 and left and right-side surfaces 16 and 18. The mop head 10 is attached to a support member 20 which is used to secure the mop head 10 to a mop handle 32.

Left and right-side surfaces 16 and 18 adjoin upper surface 14 of the mop head 10 at edges 15 and 17. However, left and right side surfaces 16 and 18 do not extend all the way from the top surface 14 of the mop head 10 to the bottom surface 12 of the mop head 10. Rather, there are sculpted cutouts or indentations 22 and 24 in the side surfaces 16 and 18 of the mop head. In the embodiment shown in FIG. 1, the sculpted cutout or indentations in the left side surface 16 is shown at reference numeral 22 and the sculpted cutout or indentations in the right side surface 18 is shown at reference numeral 24. Left and right side surfaces 16 and 18 adjoin sculpted cutouts or indentations 22 and 24 at edges 19 and 21. The sculpted cutouts or indentations 22 and 24 adjoin bottom surface 12 at edges 23 and 25.

Figure 2:
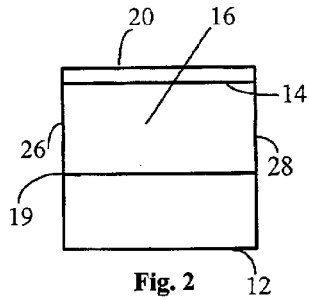
FIG. 2 is a side view of an embodiment of the mop head.
Figure 3:
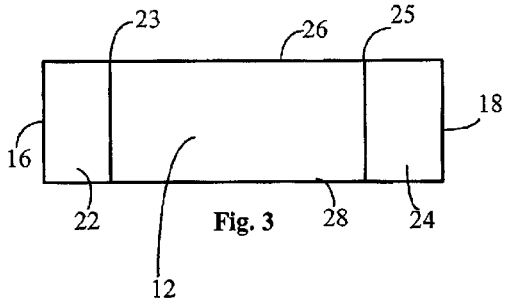
FIG. 3 is a bottom view of an embodiment of the mop head.
Figure 4:
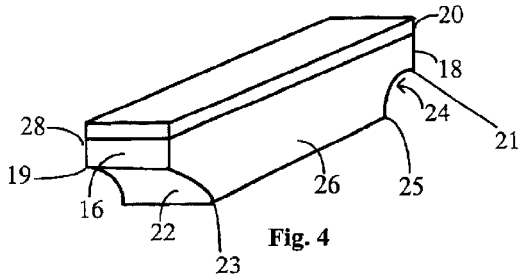
FIG. 4 is a perspective view of an embodiment of the mop head.

FIG. 2 shows a side view of an embodiment of the mop head, FIG. 3 shows a bottom view of an embodiment of the mop head and FIG. 4 shows a perspective view of an embodiment of the mop head. FIGS. 2, 3 and 4 show the features described above and, in addition, show the front and rear surfaces of the mop head 26 and 28.

Figure 5:
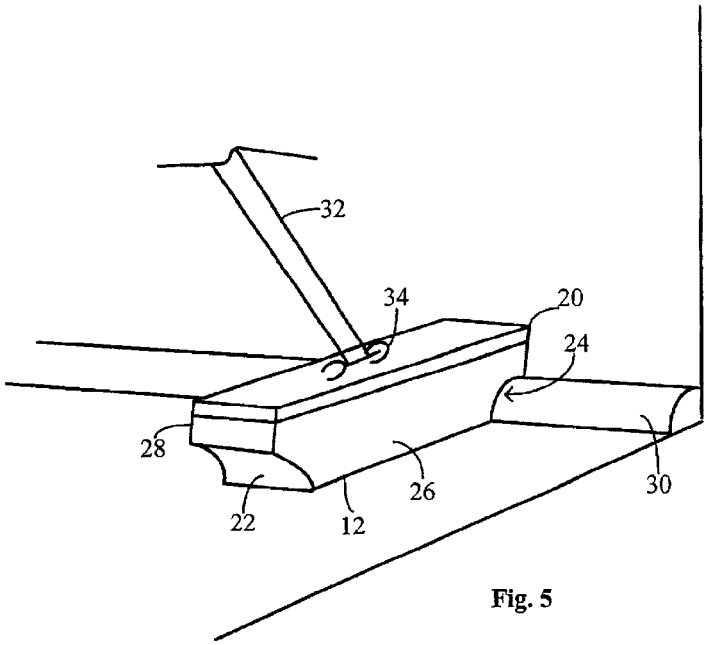
FIG. 5 is a perspective view of a mop having an embodiment of the mop head.

FIG. 5 shows an embodiment of the mop head in use as part of a mop. The mop head support member 20 is attached through a mounting mechanism 34 to the mop pole 32. In use the mop head can be used such that the bottom of the mop head 12 is running along the floor cleaning the floor while a sculpted portion 24 of the mop head is running along the floor molding 30 cleaning the molding.

There are a number of additional features that could used with the mop head described herein that would be appreciated by persons skilled in the art. For example, support member 20 should not extend beyond the side edges 16 and 18 of the mop head itself. In fact, preferably, the mop head 10 extends beyond the edge of support member 20 so that the support member 20 will not touch the wall when the mop head is being run along the floor molding as shown in FIG. 5. Alternatively, a protection member can be placed on the side of the support member 20 such that if it touches the wall it will not damage the wall.

In addition, it would be apparent to persons skilled in the art that the mop head could be made to clean a variety of types, shapes and sizes of floor molding. In the embodiment shown in FIGS. 1–5, the accurate shape of the cutout in the mop head is specifically designed to clean quarter round molding, as is normally used in a variety of buildings. However, the mop head could be designed with cutouts or indentations of a variety of types, shapes or sizes to clean a variety of types, shapes or sizes of molding.

Those skilled in the art would recognize that the mop head and method of use described herein has many applications, and that the present invention is not limited to the representative examples disclosed herein. Moreover, the scope of the present invention covers all conventionally known variations or modifications to the components and the method of use described herein, as would be known by persons skilled in the art.

What is claimed:

1. A mop head, comprising:

a rectangular parallelepiped body having a top surface, a bottom surface, a front side surface, a rear side surface, a left side surface and a right side surface, the front side and rear side surfaces comprising the long dimensions of the rectangular parallelepiped body and the left side and right side surfaces comprising the short dimensions of the rectangular parallelepiped body;

the top surface adjoining the left side surface at an edge, the edge adjoining the top surface and left side surface extending from the front surface to the rear surface of the rectangular parallelepiped body;

the top surface adjoining the right side surface at an edge, the edge adjoining the top surface and right side surface extending from the front surface to the rear surface of the rectangular parallelepiped body;

an indentation in at least one of the left or right side surfaces and in the bottom surface of the rectangular parallelepiped body such that the bottom surface adjoins the indentation at an edge and the side surface having the indention adjoins the indentation at an edge;

the indentation extending from the front surface to the rear surface of the rectangular parallelepiped body and having uniform cross sectional dimensions throughout its extent from the front surface to the rear surface of the rectangular parallelepiped body.

2. The mop head of claim 1 wherein the indentation has an arcuate shaped surface, corresponding to the shape of molding, prior to use in contact with the molding.

3. A mop, comprising:

a mop head having a rectangular parallelepiped body, the rectangular parallelepiped body having a top surface, a bottom surface, a front side surface, a rear side surface, a left side surface and a right side surface, the front side and rear side surfaces comprising the long dimension of the rectangular parallelepiped body of the left and right side surfaces comprising the short dimension of the rectangular parallelepiped body; the top surface adjoining the left side surface at an edge, the edge adjoining the top surface and left side surface extending from the front surface to the rear surface of the rectangular parallelepiped body; the top surface adjoining the right side surface at an edge, the edge adjoining the top surface and right side surface extending from the front surface to the rear surface of the rectangular parallelepiped body; an indentation in at least one of the left or right side surfaces and in the adjacent bottom surface of the rectangular parallelepiped body such that the bottom surface adjoins the indentation at an edge and the side surface having the indention adjoins the indentation at an edge; the indentation extending from the front surface to the rear surface of the rectangular parallelepiped body and having uniform cross sectional dimensions throughout its extent from the front surface to the rear surface of the rectangular parallelepiped body;

a support member attached to the top surface of the mop head; and a mop handle attached to the support member.

4. The mop of claim 3 wherein the indentation in the mop head has an arcuate shaped surface, corresponding to the shape of molding, prior to use in contact with the molding.

5. A method of mopping comprising using a mop with a mop head having a rectangular parallelepiped body, the rectangular parallelepiped body having a top surface, a bottom surface, a front side surface, a rear side surface, a left side surface and a right side surface, the front side and rear side surfaces comprising the long dimension of the rectangular parallelepiped body of the left and right side surfaces comprising the short dimension of the rectangular parallelepiped body; the top surface adjoining the left side surface at an edge, the edge adjoining the top surface and left side surface extending from the front surface to the rear surface of the rectangular parallelepiped body; the top surface adjoining the right side surface at an edge, the edge adjoining the top surface and right side surface extending from the front surface to the rear surface of the rectangular parallelepiped body; an indentation in at least one of the left or right side surfaces and in the bottom surface of the rectangular parallelepiped body such that the bottom surface adjoins the indentation at an edge and the side surface having the indention adjoins the indentation at an edge; the indentation extending from the front surface to the rear surface of the rectangular parallelepiped body and having uniform cross sectional dimensions throughout its extent from the front surface to the rear surface of the rectangular parallelepiped body;

to clean a floor and molding together.

6. The method of mopping of claim 5 wherein the floor and molding are cleaned at the same time.

7. A mop head comprising:

a rectangular parallelepiped body having a top surface, a bottom surface, a front side surface, a rear side surface, a left side surface and a right side surface, the front side and rear side surfaces comprising the long dimension of the rectangular parallelepiped body of the left and right side surfaces comprising the short dimension of the rectangular parallelepiped body;

the top surface adjoining the left side surface at an edge, the edge adjoining the top surface and left side surface extending from the front surface to the rear surface of the rectangular parallelepiped body;

the top surface adjoining the right side surface at an edge, the edge adjoining the top surface and right side surface extending from the front surface to the rear surface of the rectangular parallelepiped body;

indentations in the left and right side surfaces and in the bottom surface of the rectangular parallelepiped body such that the bottom surface adjoins the indentations at an edge and the left and right side surfaces adjoin the indentation at edges;

the indentations extending from the front surface to the rear surface of the rectangular parallelepiped body and having uniform cross sectional dimensions throughout their extent from the front surface to the rear surface of the rectangular parallelepiped body.

8. The mop head of claim 7 wherein the indentations have arcuate shaped surfaces, corresponding to the shape of molding, prior to use in contact with the molding.

* * * * *